United States Patent [19]

Claycomb

[11] Patent Number: 4,685,518

[45] Date of Patent: Aug. 11, 1987

[54] BLAST JOINT

[75] Inventor: Jack R. Claycomb, Houston, Tex.

[73] Assignee: Rickert Precision Industries, Inc., Plymouth, Mich.

[21] Appl. No.: 763,456

[22] Filed: Aug. 7, 1985

[51] Int. Cl.[4] ..... E21B 17/10

[52] U.S. Cl. ..... 166/243; 285/45; 138/147

[58] Field of Search ..... 166/243, 236, 244 C; 285/12, 45; 308/4 A; 138/36, 101, 140, 147, DIG. 6

[56] References Cited

U.S. PATENT DOCUMENTS

| | | | |
|---|---|---|---|
| 2,281,801 | 5/1942 | Reynolds et al. | 166/2 |
| 2,812,717 | 11/1957 | Brown | 103/52 |
| 2,907,351 | 10/1959 | Rohrback et al. | 166/243 |
| 2,925,097 | 2/1960 | Duesterberg | 138/64 |
| 2,991,806 | 7/1961 | Rocheville et al. | 138/101 |
| 3,034,912 | 5/1962 | Flowers | 166/243 |
| 3,365,000 | 1/1968 | Arnwine | 166/243 |
| 3,378,076 | 4/1968 | Metler | 166/45 |
| 3,379,259 | 4/1968 | Metler | 166/242 |
| 3,382,930 | 5/1968 | Ribb et al. | 166/242 |
| 3,817,805 | 6/1974 | Surikov et al. | 156/158 |
| 3,895,832 | 7/1975 | Ellis et al. | 285/322 |
| 3,995,665 | 12/1976 | Monaghan | 138/147 |
| 4,028,796 | 6/1977 | Bergstrom | 29/416 |
| 4,141,386 | 2/1979 | Bergstrom | 138/147 |
| 4,160,608 | 7/1979 | Derner et al. | 403/370 |
| 4,211,440 | 7/1980 | Bergstrom | 285/45 |
| 4,243,252 | 1/1981 | Johnson | 285/39 |
| 4,277,197 | 7/1981 | Bingham | 403/104 |
| 4,349,050 | 9/1982 | Bergstrom et al. | 138/147 |
| 4,381,821 | 5/1983 | Greene, Jr. | 166/243 |
| 4,613,165 | 9/1986 | Kuhne | 285/45 |
| 4,635,968 | 1/1987 | Kuhne | 166/243 |

FOREIGN PATENT DOCUMENTS 868122 4/1971 Canada .

OTHER PUBLICATIONS

Advertising Brochure by Blast Joints International, Inc. "Blast Joint Bulletin", vol. 3, Fall, 1983.

*Primary Examiner*—James A. Leppink
*Assistant Examiner*—Terry Lee Melius
*Attorney, Agent, or Firm*—Gunn, Lee & Jackson

[57] ABSTRACT

A blast joint comprising a series of standard length joints of production tubing is disclosed. The blast joint includes a series of cylindrical rings composed of an abrasion resistant material mounted about the tubular tubing joints forming a protective shield about the production tubing. A movable sleeve formed of cylindrical abrasion resistant rings is selectively shiftable to enclose and shield the tubing connection assemblies joining the production tubing forming the blast joint. The production tubing and abrasion resistant rings form a blast joint whose length exceeds the standard length of a single joint of production tubing.

19 Claims, 12 Drawing Figures

BLAST JOINT

BACKGROUND OF THE DISCLOSURE

The present invention is directed to a blast joint, particularly, a blast joint comprising a series of blast joint modules connected to form a blast joint having a length exceeding the standard length of production tubing for use in production zones of substantial thickness.

It is common when drilling oil and gas wells to encounter two or more producing formations or zones. In such a situation, each producing formation is produced through a separate string of production tubing extending into the well bore. Typically, a string of production tubing extends to the lowermost producing formation. A packer is set about the production tubing string between the producing formations to isolate the upper producing formation from the lower producing formation. A second string of production tubing extends into the well bore to the upper producing formation. A packer is set above the upper producing formation to close off the annulus about the two strings of production tubing so that the upper production zone is isolated between the two packers. Thus, each string of production tubing is in fluid communication with the producing formation adjacent the lower open end of the production tubing. This is commonly referred to as a dual completion well.

Downhole well equipment is exposed to erosive elements in the well bore. This is particulaly true in a dual completion well where one string of production tubing extends through an upper producing zone. Flow into the well bore in the upper producing zone, particularly in formations producing high pressure gas, is at high velocities. Abrasive materials, such as unconsolidated sand grains, are often entrained in the fluid stream and impinge on the production tubing. This action is extremely abrasive and erodes the pipe surface, thus requiring replacement of the production tubing. This is a very time consuming process which may be repeated often, particularly for wells having high sand content.

The erosiveness of producing fluids is well known in the prior art and many different efforts have been made to solve the problem. U.S. Pat. No. 4,381,821 discloses a series of elements composed of an abrasion resistant material mounted about a tubular member. The elements form a protection ring about the tubing and are supported on the tubular member by upper and lower supports which provide tongue and groove engagement with the upper end of an upper ring and with the lower end of a lower ring.

U.S. Pat. No. 3,379,259 discloses a system for protecting the production tubing comprising a plurality of baffle sleeves concentrically mounted about the production tubing in the area of an upper producing formation. Each of the sleeves includes perforations which are staggered in relations to perforations in the next adjacent sleeve so that the erosive fluid entering the well is forced to follow a tortious flow path before it impinges on the production tubing. The changing flow path causes the erosive fluid to decrease its kinetic energy and reduce its impact velocity before it reaches the production tubing, thereby reducing erosion of the tubing.

U.S. Pat. Nos. 4,141,368 and 4,028,796 to Bergstrom disclose a blast joint comprising a series of short cylindrical rings composes of cemented tungsten carbide and the method of producing a blast joint for oil well production tubing. The rings are disposed coaxially in contact with each other between end retaining rings mounted upon a supporting steal tube which comprises a single section or joined sections of production tubing.

In U.S. Pat. No. 4,211,440, Bergstrom suggests that the successful functioning of the blast joint in a well is dependent upon the handling of the blast joint before it is positioned in the well. To this end, Bergstrom discloses the introduction of a yieldable compression spring encircling the production tubing and disposed between the end of the carbide rings and the ring retaining clamp to allow freedom of movement of the rings relative to the tubing to permit handling and moving of the assembled blast joint without damage to the carbide rings.

The use of blast joints as protective structures for protecting production tubing is well recognized in the prior art. However, blast joints of the prior art are typically limited to providing protection of a single joint of production tubing. If a blast joint of an extended length is required, a series of tubing joints or pipe joined by a flush joint are used to form the blast joint. The prior art method of forming blast joints having flush joint connections is exemplified by U.S. Pat. No. 4,028,796 to Bergstrom. Flush joints, however, substantially reduce the tensile strength of the production tubing string at the flush joint connection. The blast joint of the present disclosure overcomes the disadvantages of flush joint connections by providing a shielded connection assembly for joining the threaded pin end of a tubular member to the threaded box end of a tubular member connected therewith to form the blast joint.

SUMMARY OF THE DISCLOSURE

The invention of the present disclosure is directed to an improved blast joint of substantial length. The blast joint of the invention comprise a series of erosion resistant rings mounted about a series of tubular members connected end to end. The pin and box ends of the tubular members are connected by a cross-over connector assembly which is shielded from erosive elements by an adjustable erosion resistant sleeve which is positioned to enclose the cross-over connector assembly prior to positioning the blast joint in the well bore. The erosion resistant rings are compressed between end located retaining collars permitting some degree of movement of the erosion resistant rings relative to the supporting tubular members.

BRIEF DESCRIPTION OF THE DRAWINGS

So that the manner in which the above recited features, advantages and objects of the present invention are attained and can be understood in detail, a more particular description of the invention briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

DETAILED DESCRIPTION OF THE PREFERRED EMBODIMENT

Figure 1:
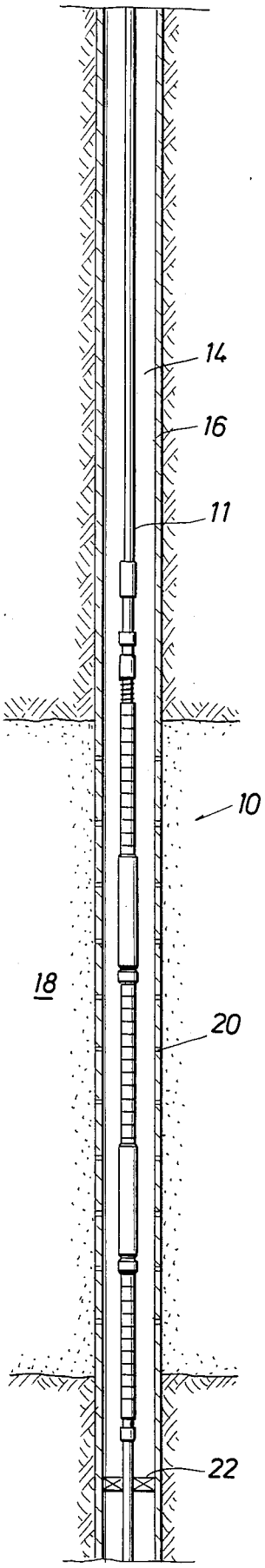
FIG. 1 is a side elevational view of a production string in a well bore showing the improved blast joint of the present invention protecting the production tubing in the interval of a producing formation.

Referring first to FIG. 1, the improved blast joint of the present disclosure is generally identified by the reference numeral 10. The blast joint 10 forms a part of a production tubing string 11 which extends in a well bore 14. The well bore 14 is defined by a casing string 16 traversing a producing formation 18. The casing 16 is provided with a plurality of perforations 20 which define an open production interval in the formation 18.

A packer 22 is disposed between the productive formation 18 and a lower productive formation (not shown in the drawings) in order to isolate these formations from one another so that there is no communication between these formations within the well. A production tubing string 11 is disposed in the well as illustrated and extends from the wellhead to below the packer 22 to the lower productive formation. Fluids from the lower productive formation thus are produced through the interior of the production tubing string 11 and carried to the surface of the well for delivery to a storage tank facility. Fluids produced from the productive formation 18 flow to the surface in the annular space between the production tubing string 11 and the casing 16. If desired a second packer may be disposed above the productive formation 18 and a second tubing string provided in the well bore 14 and terminating adjacent the perforations 20 providing a production passage to the surface of fluids produced from the productive formation 18.

The production equipment thus far described is conventional. Also, it will be understood that the downhole arrangement thus far described is illustrative only and other suitable arrangements may be used. For example, the well bore 14 may be cased or uncased. Alternatively, the well bore 14 may be partially cased and partially uncased. Other well completion practives are also available and are well known to those skilled in the art.

In accordance with the present disclosure, there is disposed within the well bore 14 a production tubing 11 which is in fluid communication with a productive formation below the producing formation 18. The blast joint 10 forms a portion of the production tubing 11 and is disposed in the well bore opposite the producing interval of the productive formation 18 defined by the perforations 20. The blast joint 10 is a protective sheath or shield of erosion resistant material which encloses a portion of the production tubing 11 to protect it from the erosive action of the high velocity fluid and entrailed particles entering the well bore 14 through the perforations 20. The erosion resistant material forming the blast joint of the present disclosure may be made of any suitable material exhibiting erosion resistant properties. In the preferred embodiment, however, described in greater detail hereinafter, the erosion resistant material is tungsten carbide formed in rings which are stacked end to end and carried on the tubular members forming the blast joint 10 between end located retention clamps. Ceramic is also a suitable erosion resistant material which may be used to form the blast joint of the present disclosure.

Figure 2A:
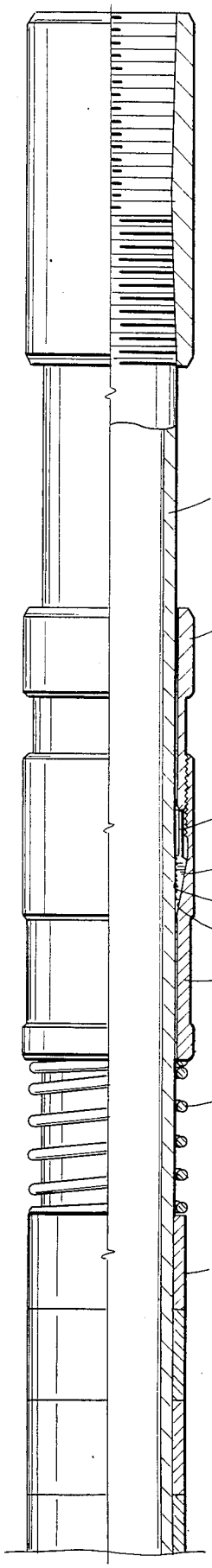
FIG. 2A is a partial, vertical, longitudinal, sectional view of the improved blast joint of the present invention showing the upper retention collar.
Figure 2B:
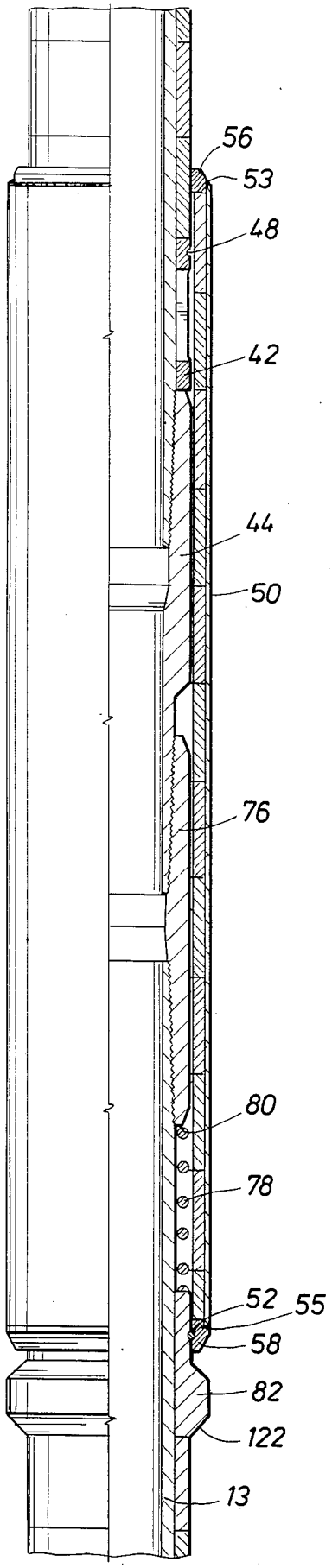
FIG. 2B is a similar vertical, longitudinal, sectional view of the improved blast joint of the present invention showing the erosion resistant sleeve assembly enclosing the tubing connector assembly.
Figure 2C:
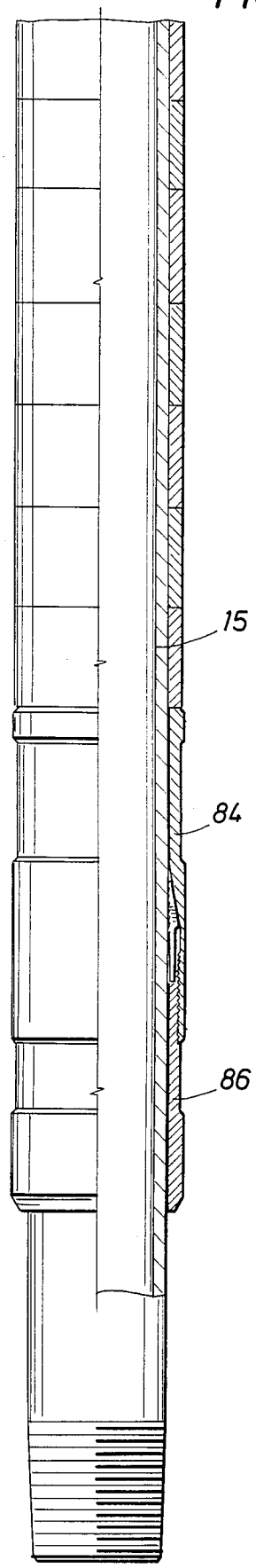
FIG. 2C is a similar vertical, longitudinal, sectional view of the improved blast joint of the present invention showing the lower retention collar.

Referring now to FIGS. 2A through 2C, the blast joint 10 of the present disclosure will be described from top to bottom. The blast joint of the present disclosure shown in FIGS. 2A through 2C comprises several tubular members joined end to end in a manner to be described. For example, the blast joint 10 of the present disclosure may comprise one or more joints of production tubing joined together and enclosed by an erosion resistant protective assembly of erosion resistant rings 24. The blast joint 10 is incorporated in the production tubing string 11 disposed within the well bore 14 as shown in FIG. 1.

The upper portion of the blast joint 10 comprises a plurality of rings 24 assembled on a tubing member 12 in end face to face contact and are held in compression between end located locking assemblies 26. At the upper end of the blast joint 10, the locking assembly 26 comprises a slip ring 28 and a bowl ring 30 threadedly engaged about the tubing 12. Initially, the locking assembly 26 is slipped over the pin end of the tubing 12 and clamped thereon at a desired location. The slip ring 28 includes a plurality of flexible fingers 32 extending from a threaded portion thereof. The fingers 32 are provided with a serrated surface 34 for engaging the surface of the tubing 12. The fingers 32 include a tapered external surface 36 which coacts with an oppositely tapered surface 38 formed on the internal body of the bowl ring 30 to compress the fingers 32 in locking engagement with the tubing 12.

After the locking ring assembly 26 is clamped to the tubing 12, a spring 40 and a plurality of carbide rings 24 are slid over the pin end of the tubing 12. The carbide rings 24 fit snugly on the tubing 12 and abut against the spring 40. The number of carbide rings 24 mounted on the tubing 12 may vary depending upon the axial length of each ring; however, a sufficient number of carbide rings 24 are used to totally encase the tubing 12 from the spring 40 to a support sleeve 42 located adjacent the pin end of the tubing 12. An internally threaded connector 44, commonly referred to as a cross over sub, is threaded on the pin end of the tubing 12 in abutting engagement with the support sleeve 42 providing a lower stop shoulder for the stack of carbide rings 24. Thus, the carbide rings 24 are compressed between the spring 40 and the support sleeve 42 and maintained in end face to face contact providing a protective shield for the tubing 12.

Figure 3:
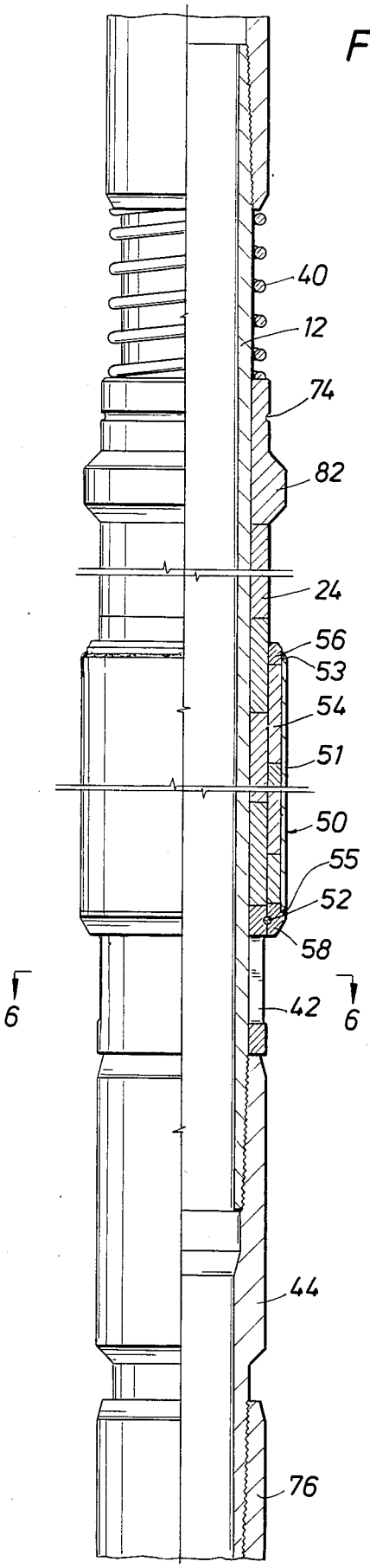
FIG. 3 is a side elevational view, partially broken away, showing the erosion resistant sleeve assembly of the blast joint of the invention positioned above the tubing connector assembly.
Figure 6:
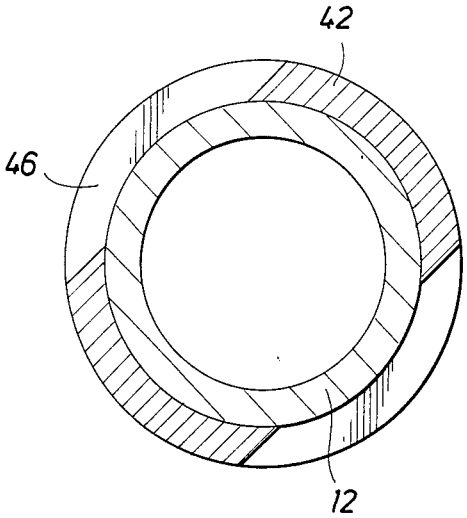
FIG. 6 is a sectional view taken along line 6—6 of FIG. 3.

Referring now to FIGS. 3 and 6, the support sleeve 42 is shown in greater detail. The support sleeve 42 comprises a substantially cylindrical, open ended member. The body of the support sleeve 42 includes a pair of oppositely located slots or apertures 46 permitting access to the tubing 12. The slots 46 are sufficiently large to permit a pipe wrench or the like to engage the tubing 12; however, the structural integrity of the support sleeve 42 is not impaired and the support sleeve 42 will not collapse under the load of the stack of rings 24 supported thereon. The support sleeve 42 includes an upper collar or shoulder portion in abutting engagement with the lowermost carbide ring 24. A circumferential groove 48 is formed about the external upper collar portion of the support sleeve 42 and best shown in Fig. 2B. The groove 48 cooperates with a corresponding groove 72 in a lower cover ring 58 of a sleeve assembly 50 for receiving a retaining wire 52 for maintaining the sleeve assembly 50 in a desired position.

Referring now specifically to FIG. 3, the movable protective sleeve assembly 50 of carbide rings 54 is shown in the up or open position. When the blast joint 10 of the present disclosure is out of the well bore, the sleeve assembly 50 is located in the position shown in FIG. 3, above the support sleeve 42. In this manner, access is permitted to the tubing 12 through the slots 46 of the support sleeve 42 so that a pipe wrench may be used for threading the cross-over sub 44 to the pin end of the tubing 12, and subsequently to the box end or coupling connecting the next tubing member extending therebelow. A sleeve 51 encases the carbide rings 54 between an upper cover ring 56 and the lower cover ring 58. The carbide rings 54 have an internal diameter slightly greater than the outer diameter of the carbide rings 24 permitting relative telescoping movement therebetween. The upper and lower cover rings 56 and 58 are welded to the ends of the sleeve 51 at 53 and 55, respectively. The rings 54 are compressed between the cover rings 56 and 58 during assembly of the sleeve assembly 50, ensuring end face to face contact between adjacent rings 54.

Figure 5:
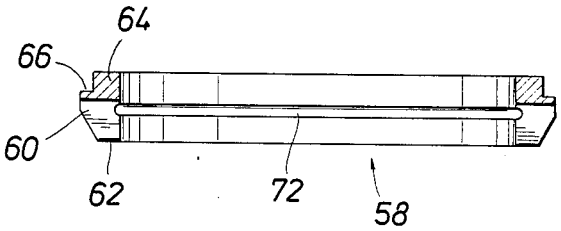
FIG. 5 is a sectional view of the lower cover ring taken along line 5—5 of FIG. 4.
Figure 4:
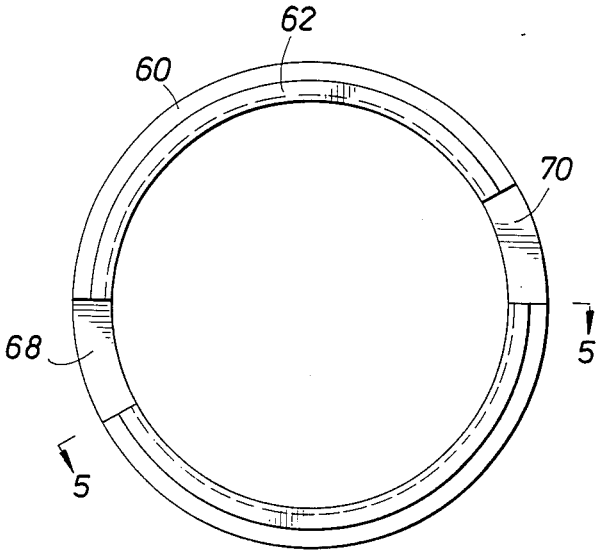
FIG. 4 is a bottom plan view of the lower cover ring for the erosion resistant sleeve of the invention.

The lower cover ring 58 is shown in greater detail in FIGS. 4 and 5. The internal diameter of the cover ring 58 is slightly greater than the external diameter of the support sleeve 42 so that it fits snugly about the support sleeve 42 as shown in FIG. 3. The cover ring 58 includes a short tubular body 60 whose outer diameter tapers inwardly at the lower end thereof to a flat planar circumferential surface 62 defining the lower or bottom end of the cover ring 58. The opposite end of the body 60 includes an upstanding cylindrical extension 64 whose outer diameter is slightly less than the inner diameter of the sleeve 51. A circumferential shoulder 66 provides an abutment surface for the sleeve 51 which is retained between the lower cover ring 58 and the upper cover ring 56. The sleeve 51 telesclopes about and frictionally engages the extension 64 of the lower cover ring 58 and is welded thereto. Similarly, the opposite end of the sleeve 51 is welded to the upper cover ring 56, thereby completely enclosing the carbide rings 54 and forming a movable assembly of stacked rings 54 slidably along the blast joint 10.

The lower end of the body 60 of the cover ring 58 is slotted at 68 and 70 permitting access to the internal groove 72 formed in the body 60 as best shown in FIG. 4. The internal groove 72 cooperates with the external groove 48 formed on the support sleeve 42 to define a passage therebetween for receiving the retaining wire 52. The slots 68 and 70 permit convenient insertion or removal of the retaining wire 52 for locating the carbide ring assembly along the blast joint 10.

The blast joint 10 described thus far comprises the uppermost tubing joint 12 including a cross-over sub 44 threaded on the pin end thereof. In FIG. 2B, a portion of the intermediate tubing joint 13 is shown. The intermediate tubing joint 13 is provided with a conventional buttress or other non-upset threaded coupling 76 for threadable connection to the pin end of the cross-over sub 44. The intermediate tubing joint 13 is enclosed by a series of carbide rings 24 much in the same manner as the tubing joint 12. A spring 78 is disposed about the tubing joint 13 in abutment with a shoulder 80 of the buttress coupling 76. A tungsten carbide guide ring 82 and a plurality of carbide rings 24 are slid about the tubing joint 13 and supported at the lower end thereof by a support sleeve 42 and a cross-over sub 44 in the same manner as described above regarding tubing joint 12. Any desired number of intermediate joints may be serially connected to provide a blast joint 10 of the required length. Each tubing joint is connected by a cross-over sub thereby eliminating flush joint connections and providing a blast joint whose tensile strength equals or exceeds the tensile strength of the complete tubing string.

The lowermost or bottom tubing joint 15, partially shown in FIG. 2C, is substantially identical to the intermediate tubing joint 13. That is, at the upper end thereof, the tubing joint 15 includes a similar buttress or non-upset coupling 76, compression spring 78, and carbide guide ring 82 as shown in FIG. 2B. A series of carbide rings 24 are carried on the bottom tubing joint 15 supported on a lower lock assembly comprising a bowl ring 84 and a slip ring 86 which is substantially identical to the upper lock assembly 26 on the tubing joint 12.

Figure 9:
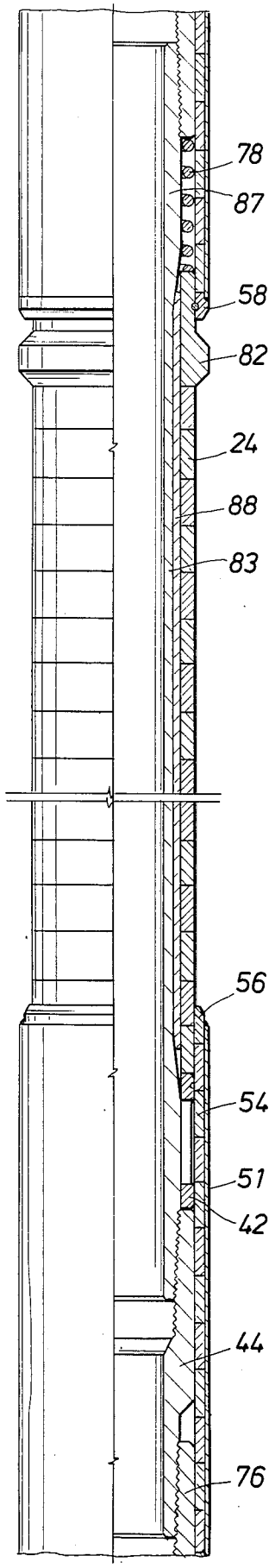
FIG. 9 is a side elevational view, partially broken away showing an alternate embodiment of the blast joint of incorporating a spacer sleeve between the tubing and the erosion resistant rings.
Figure 10:
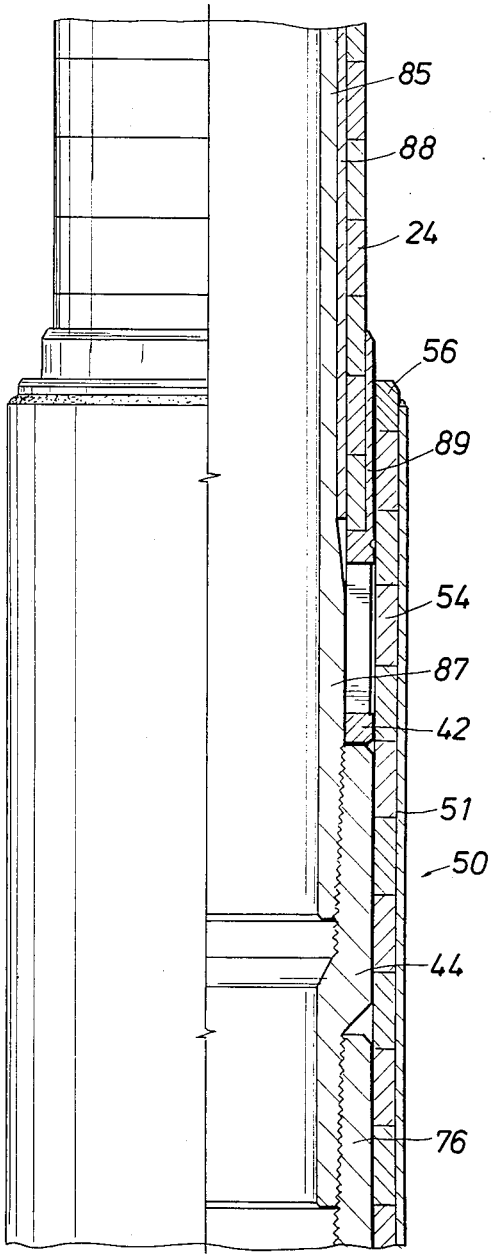
FIG. 10 is a sectional view of an alternate embodiment of the blast joint of the invention incorporating a cylindrical extension on the support sleeve separating the resistant sleeve assembly from the erosion resistant rings.

Referring now to FIGS. 9 and 10, alternate embodiments of the blast joint of the invention are shown. The blast joints of FIG. 9 and 10 are substantially similar to the blast joint of FIGS. 2A through 2C and therefore like reference numerals have been used to identify like elements. The tubing joints 12, 13, and 15 in FIGS. 2A through 2C include conventional non-upset external threads. The tubular members 83 and 85 shown in FIGS. 9 and 10 are provided with external upset threads at each end thereof. Thus, the external diameter of the tubing joints 83 and 85 is increased at each end 87. To accommodate the enlarge ends 87 of the tubing joint 83 and 85, the internal diameter of the rings 24 is increased so that the rings 24 will easily slip over the enlarged ends 87 for forming the blast joint. Consequently, a gap is created between the main body portion of the tubing joints 83 and 85 and the rings 24. Consequently, the rings 24 may move relative to each other toward or away from the body of the tubing joints 83 and 85 increasing the likelihood of chipping, cracking or breaking. To prevent relative movement between the rings, a spacing liner 88 is mounted about the body of the tubing joints 83 and 85 prior to installation of the rings 24. The liner 88 may be fabricated of any suitable material of sufficient thickness to fill the gap between the external surface of the tubing joints 83 and 85 and the rings 24. It is desired that the liner 88 be fabricated of lightweight material so as not to appreciably increase the overall weight of the blast joint. For example, the liner 88 may be fabricated of a plastic or elastomeric material such as a fiberglass or polyethylene tube.

The liner 88 may be formed in strips which are mounted on the exterior of the tubing joints 83 with adhesive or the like. However, in the preferred embodiment, the liner 88 is premolded to a substantially cylindrical shape and split along its full length. In this manner, the liner 28 may be pulled apart and slipped on the tubing joints 83 and 85. The liner 88 is sufficiently elastic to return to its original shape once installed about the tubing joints 83 and 85. The liner 88 completely fills the annular space between the tubing joints 83, 85 and the rings 24 substantially eliminating relative movement between the rings 24 insuring that end face to face contact between the rings 24 is maintained.

For larger sizes of external upset tubing, the dimensions of the connectors, for example, the cross-over sub 44, also increase. In the embodiment of FIG. 10, the external diameter of the cross-over sub 44 is such that the internal diameter of the carbide rings 54 is greater than the external diameter of the carbide rings 24. Thus, a gap is created in the area of overlap between the rings 24 and the rings 54. The gap between the rings 24 and 54 is filled by an upstanding circumferential extension 89 extending upwardly from the support sleeve 42. Thus, the extension 89 is sandwiched between the lowermost rings 24 and the upper most rings 54 of the sleeve assembly 50 ensuring that the rings 54 are maintained in end face to face contact.

The blast joint 10 of the present disclosure comprises a series of tubular member encased or shielded by erosion resistant rings mounted thereon in the manner described above. Installation of the blast joint 10 is accomplished by fitting each joint 12, 13 and 15 from the oil rig platform floor and attaching each joint to the tubing string 11 in the well bore 14. Running tubing in a well bore is well known in the prior art. Typically, the lower portion of the tubing string is suspended in the well bore from the oil rig platform floor. Pipe slips are usually used to grip the upper end of the tubing string and suspend it from the rotary table while the next tubing joint is threaded to the upper end of the tubing string. The tubing string is then lifted slightly and the pipe slips are removed permitting the tubing string to be lowered in the well bore. The process is repeated until the tubing string is completed.

When incorporating a blast joint in a tubing string, difficulties may be encountered, particularly when the blast joint is of substantial length. The carbide rings, while particularly resistant to the erosive action of fluids in the well bore, are brittle and may chip, crack or break during the installation process if not properly handled. The carbide rings tend to chip in compression and therefore standard pipe slips cannot be used to suspend the tubing string and blast joint in the well bore while connecting the next joint thereof.

Figure 7:
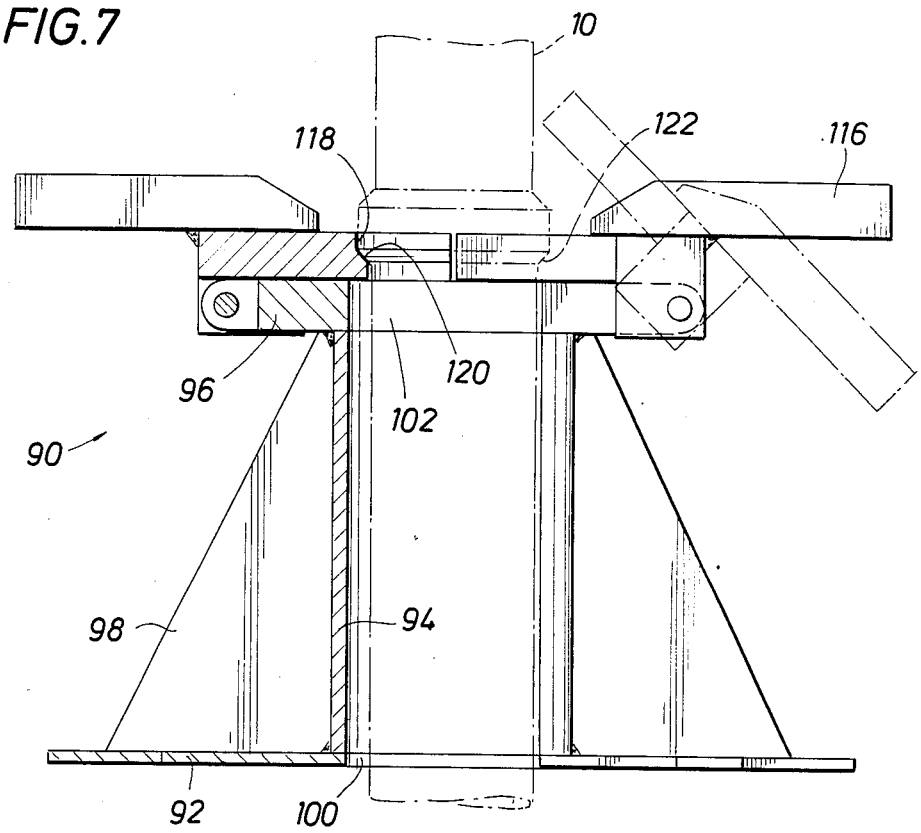
FIG. 7 is a sectional view of the base assembly for supporting the blast joint of the invention preparatory to lowering in the well bore.
Figure 8:
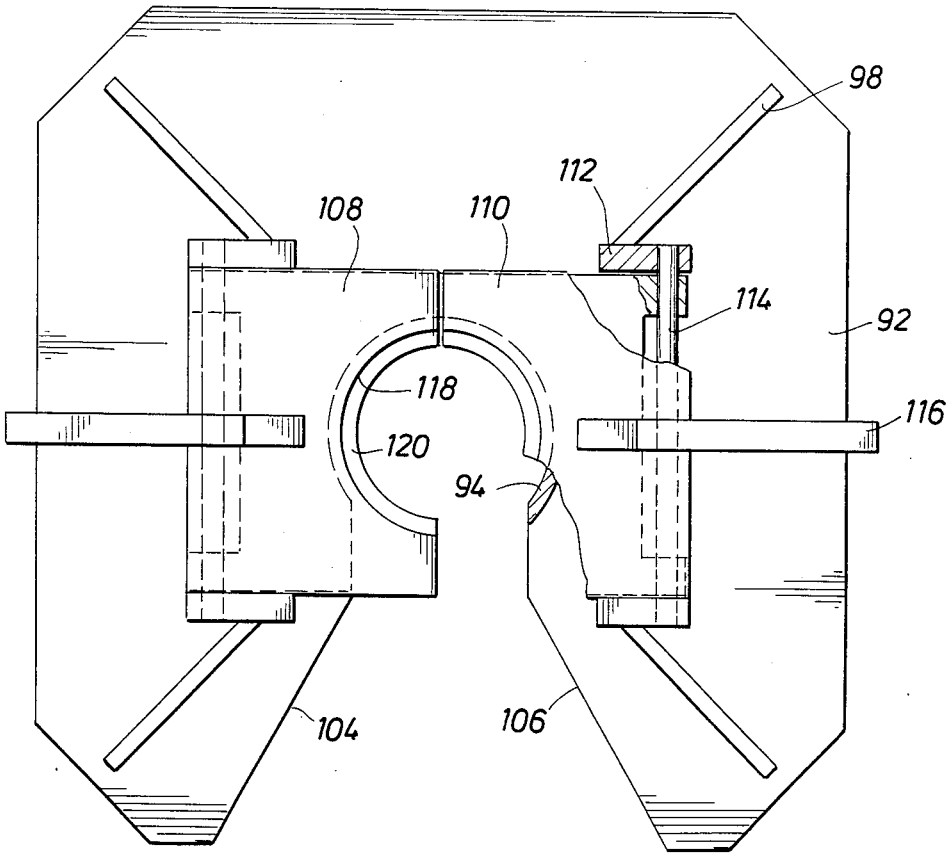
FIG. 8 is a top plan view of the base assembly.

Problems associated with installing blast joints are overcome by using the base assembly 90 shown in FIGS. 7 and 8 during the installation process. The base assembly 90 permits engagement of the blast joint 10 during the installation process in a manner to be described hereinafter. The base assembly 90 includes a support base 92. A substantially cylindrical support column 94 extends upwardly from the support base 92 to a cap 96. The support column 94 is braced by a plurality of column braces 98 radially disposed about the support column 94. The column braces 9 extend from the support base 92 to the cap plate 96 forming a rigid radial support structure for the support column 94. The support column 94 is centrally located on the support base 92 and circumscribes a hole 100 formed in the support base 92. The cap plate 96 is substantially rectangular in shape and includes a hole 102 therethrough which is coaxially aligned with the axial passage of the support column 94 and the hole 100. The support column 94 is welded to the support base 92 and the cap plate 96 to form the base assembly 90 as shown in FIG. 7. The base assembly 90 is provided with a lateral slot permitting the blast joint 10 to be laterally received within the support column 94. The lateral slot in the support base 92 is defined by inwardly tapering shoulders 104 and 106 which form a guide for positioning the blast joint 10 in the support column 94.

Supported on the cap plate 96 is a tool support member comprising a pair of tool support plates 108 and 110 supported on the cap plate 96. The tool support plates 108 and 110 are provided with hinge blocks 112 for receiving a pivot rod 114 therethrough. The pivot rod 114 extends through each end of the cap plate 96 and through the hinge blocks 112 permitting the tool support plates 108 and 110 to rotate about the pivot rods 114 toward or away from the cap plate 96. Support handles 116 are provided for manually manipulating the tool support plates 108 and 110.

The tool support plates 108 and 110 are provided with a semi-circular recess which cooperate to define a tool support opening defined by circumferential wall 118 which terminates at an inwardly tapering shoulder 120. The profile presented by the wall 118 and shoulder 120 substantially matches the profile of the guide ring 82 which includes a tapered shoulder 122 for engagement with the shoulder 120 of the tool support member for suspending the blast joint 10 therefrom.

The base assembly 90 permits the installation of the blast joint 10 without cracking, chipping or otherwise subjecting the carbide rings to high localized compressive stresses. The tubing string 11 is installed in the usual manner. However, when the blast joint 10 is to be installed, the base plate 90 is positioned on the rotary table coaxially aligned with the tubing string 11. The bottom joint 15 of the blast joint 10 is raised from the platform floor and threaded to the tubing string joing suspended from the rotary table. The joint 15 is lowered in the well bore 14 through the base assembly 90. The diameter of the axial passage through the support column 94 is greater than the greatest diameter of the blast joint 10 so that the blast joint passes through the base assembly 90 without contacting the carbide rings 24. The blast joint member 15 and the tubing string 11 therebelow is then suspended from the base assembly 90 upon rotating the tool supports 108 and 110 to the closed positions that the guide ring 82 engages the shoulder 120.

The intermediate blast joint 13 is then raised from the platform floor and the pin end of the cross-over sub 44 is threaded to the coupling 76 of the joint 15 projecting above the base assembly 90. Recall that at this juncture, the carbide ring sleeve assembly 50 is retained above the support sleeve 42 providing adequate room for platform personnel to securely thread the intermediate joint 13 to the joint 15. Upon completion of the connection, the retaining wire 52 is removed and the carbide ring sleeve assembly 50 is lowered to the guide ring 82 and the retaining wire 52 is inserted in the receiving slot defined by the groove 74 on the guide ring 82 and the matching groove 72 on the lower cover ring 58. The intermediate joint 13 is then lifted slightly permitting the tool support plates 108 and 110 to be rotated away from the cap plate 96 so that the intermediate joint 13 may be lowered into the well bore 14. The above process is repeated for each subsequent joint forming the blast joint 10.

While the foregoing is directed to the preferred embodiment of the present invention, other and further embodiments of the invention may be devised without departing from the basic scope thereof, and the scope thereof is determined by the claims which follow.

What is claimed is:

1. A blast joint comprising:

(a) at least two tubular members having threaded opposed ends;

(b) a plurality of erosion resistant rings encasing said tubular members;

(c) support means for supporting said erosion resistant rings about said tubular member;

(d) a cross-over connector externally threaded at one end and internally threaded at the other end for connecting said tubular members to form said blast joint, said cross-over connector providing a shoulder for supporting said erosion resistant rings on said tubular members;

(e) a support sleeve mounted about at least one of said tubular members, said support sleeve including slot means permitting access for gripping said tubular members therethrough for threadably connecting said cross-over connector to said tubular members; and (f) a ring assembly supported by said support sleeve in telescoping relation about said erosion resistant rings, said ring assembly being movable between a first and second position, wherein said ring assembly encloses said cross-over connector upon shifting said ring assembly to said second position.

2. The apparatus of claim 1 wherein said support sleeve includes a circumferential extension projecting from the upper end of said support sleeve, said extension surrounding and enclosing the lowermost erosion resistant rings.

3. The apparatus of claim 1 including an erosion resistant guide ring mounted about at least one of said tubular members, said guide ring supporting said ring assembly upon shifting said ring assembly to said second position.

4. The apparatus of claim 1 wherein said tubular members and said erosion resistant rings define an annular space therebetween, said annular space extending between said threaded opposed ends of said tubular members.

5. The apparatus of claim 4 including a liner mounted about each of said tubular members, said liner enclosing said tubular members between said threaded opposed ends and substantially filling said annular space.

6. The apparatus of claim 1 including a pair of spaced clamping collars, one of said pair of clamping collars mounted on one of said tubular members defining the upper end of said blast joint and the other of said pair of clamping collars mounted on one of said tubular members defining the lower end of said blast joint, said clamping collars retaining said erosion resistant rings on said tubular members.

7. The apparatus of claim 6 wherein said clamping collars comprise a bowl ring and slip ring threadably connected, said slip ring including a plurality of serrated fingers for gripping engagement with said tubular members.

8. The apparatus of claim 6 including spring means mounted about said tubular members at one end of said erosion resistant rings, said spring means applying a compressive force on said erosion resistant rings and being yieldable axially in response to movement of said erosion resistant rings along said tubular members.

9. The apparatus of claim 1 wherein said ring assembly comprises a pair of spaced cover rings separated by a sleeve members, said cover rings retaining a plurality of carbide rings therebetween.

10. The apparatus of claim 9 wherein the lower cover ring of said pair of cover rings includes a circumferential groove formed on the internal surface thereof, said lower cover ring further including a pair of opposed slots providing access to said circumferential groove from the exterior of said lower cover ring.

11. The apparatus of claim 10 wherein said support sleeve includes a groove formed on the exterior surface of said support sleeve, said groove on said support sleeve cooperating with said circumferential groove on said lower cover ring to form a circumferential passage for receiving a retaining member therein for locking said ring assembly to said support sleeve upon shifting said ring assembly to said first position.

12. The apparatus of claim 10 including an erosion resistant guide ring mounted about at least one of said tubular members, said guide ring supporting said ring assembly upon shifting said ring assembly to said second position.

13. The apparatus of claim 12 wherein said guide ring includes a groove formed on the exterior surface of said guide ring, said groove on said guide ring cooperating with said circumferential grove on said lower cover ring to form a circumferential passage for receiving a retaining member therein for locking said ring assembly to said guide ring upon shifting said ring assembly to said second position.

14. A blast joint comprising:

(a) at least two tubular members having threaded opposed ends;

(b) a plurality of erosion resistant rings encasing said tubular members;

(c) support means for supporting said erosion resistant rings about said tubular member;

(d) connector means for connecting said tubular members to form said blast joint; and (e) at least one ring assembly supported on said tubular members in telescoping relation about said erosion-resistant rings, said ring assembly being movable between a first and second position, wherein said ring assembly encloses said connector means upon shifting said ring assembly to said second position.

15. The apparatus of claim 14 wherein said support means includes a support sleeve mounted about at least one of said tubular members, said support sleeve including slot means permitting access for gripping said tubular members therethrough for threadeably connecting said connector means to said tubular members.

16. The apparatus of claim 15 wherein said support sleeve includes a circumferential extension projecting from the upper end of said support sleeve, said extension surrounding and enclosing the lowermost erosion resistant rings.

17. The apparatus of claim 15 wherein said ring assembly comprises a plurality of carbide rings retained between a pair of spaced cover rings separated by a sleeve member, said carbide rings having an inside diameter slightly greater than the outside diameter of said erosion resistant rings permitting telescoping movement of said ring assembly relative to said erosion resistant rings.

18. The apparatus of claim 17 wherein said tubular members and said erosion resistant rings define an annular space therebetween, said annular space extending between said threaded opposed ends of said tubular members.

19. The apparatus of claim 18 including a liner mounted about each of said tubular members, said liner enclosing said tubular members between said threaded opposed ends and substantially filling said annular space.

* * * * *